US006889918B2

(12) United States Patent
Harcombe

(10) Patent No.: US 6,889,918 B2
(45) Date of Patent: May 10, 2005

(54) FUEL INJECTOR

(75) Inventor: Anthony Harcombe, Richmond (GB)

(73) Assignee: Delphi Technologies, Inc., Troy, MI (US)

( * ) Notice: Subject to any disclaimer, the term of this patent is extended or adjusted under 35 U.S.C. 154(b) by 360 days.

(21) Appl. No.: 10/108,134

(22) Filed: Mar. 27, 2002

(65) Prior Publication Data

US 2002/0158139 A1 Oct. 31, 2002

(30) Foreign Application Priority Data

Mar. 27, 2001 (GB) ..... 0107575

(51) Int. Cl.[7] ..... F02M 59/00; F02M 61/00; F02M 63/00; F02M 47/02; B05B 1/30

(52) U.S. Cl. ..... 239/533.2; 239/88; 239/585.5

(58) Field of Search ..... 239/533.2, 88, 239/585.5, 124, 533.3, 533.8, 533.9, 585.1, 585.2, 585.3, 585.4, 89, 91, 92; 251/30.01, 37, 129.15, 129.21

(56) References Cited

U.S. PATENT DOCUMENTS

| | | | | |
|---|---|---|---|---|
| 3,680,782 | A | | 8/1972 | Monpetit et al. |
| 5,396,926 | A | | 3/1995 | Pataki et al. ..... 137/596.17 |
| 5,779,149 | A | * | 7/1998 | Hayes, Jr. ..... 239/124 |
| 5,806,766 | A | * | 9/1998 | Krueger et al. ..... 239/96 |
| 5,839,412 | A | | 11/1998 | Stockner et al. ..... 123/446 |
| 5,915,623 | A | * | 6/1999 | Knight et al. ..... 239/88 |
| 6,105,884 | A | | 8/2000 | Molnar et al. |
| 6,113,014 | A | * | 9/2000 | Coldren et al. ..... 239/585.1 |
| 6,123,275 | A | | 9/2000 | Geiger et al. |
| 6,168,087 | B1 | * | 1/2001 | Cooke ..... 239/1 |
| 6,186,421 | B1 | | 2/2001 | Wahba et al. |
| 6,189,817 | B1 | | 2/2001 | Lambert |
| 6,250,563 | B1 | * | 6/2001 | Frank et al. ..... 239/88 |
| 6,260,537 | B1 | | 7/2001 | Lamb et al. |
| 6,264,112 | B1 | | 7/2001 | Landschoot et al. |
| 6,276,339 | B1 | | 8/2001 | Shebert, Jr. et al. |
| 6,279,840 | B1 | | 8/2001 | Buckley |
| 6,318,641 | B1 | | 11/2001 | Knebel et al. |
| 6,328,232 | B1 | | 12/2001 | Haltiner, Jr. et al. |
| 6,336,595 | B1 | | 1/2002 | Barbier |
| 6,338,445 | B1 | | 1/2002 | Lambert et al. |
| 6,340,017 | B1 | | 1/2002 | Dick |
| 6,340,121 | B1 | | 1/2002 | Lambert |
| 6,345,606 | B1 | | 2/2002 | Ricci-Ottati et al. |
| 6,363,917 | B1 | | 4/2002 | Hopley |
| 6,364,222 | B1 | | 4/2002 | Haltiner, Jr. et al. |

(Continued)

FOREIGN PATENT DOCUMENTS

| | | | |
|---|---|---|---|
| DE | 19823937 | A1 | 12/1999 |
| DE | 19940290 | A1 | 3/2001 |
| EP | 0825341 | A1 | 2/1998 |
| EP | 1063418 | A2 | 12/2000 |
| GB | 2336628 | | 10/1999 |
| GB | 2353564 | A | 2/2001 |

*Primary Examiner*—Michael Mar
*Assistant Examiner*—Darren Gorman
(74) *Attorney, Agent, or Firm*—David P. Wood

(57) ABSTRACT

A fuel injector including a control valve arrangement for controlling fuel pressure within a control chamber comprises a control valve member which is movable between a first position in which the control chamber communicates with a source of high pressure fuel and a second position in which the control chamber communicates with a low pressure fuel drain and communication between the control chamber and the source of high pressure fuel is broken. The control valve arrangement includes a restricted flow path for restricting the rate of flow of fuel from the source of high pressure fuel to the control chamber when the control valve member is moved towards its first position. The provision of the restricted flow path prevents unbalanced hydraulic forces acting on the control valve member when it moves towards its first position, which can otherwise lead to valve needle dither between injecting and non-injecting states.

10 Claims, 3 Drawing Sheets

U.S. PATENT DOCUMENTS 6,373,363 B1 4/2002 Spankowski et al.
6,378,503 B1 4/2002 Lambert
6,390,067 B1 5/2002 Haltiner, Jr. et al.
6,390,385 B1 5/2002 Hardy et al.
6,405,940 B2 * 6/2002 Harcombe et al. ..... 239/88
6,408,801 B1 6/2002 Frostick et al.
6,412,712 B1 7/2002 Buckley
6,420,817 B1 7/2002 Ricci-Ottati et al.
6,421,913 B1 7/2002 Bonnah, II et al.
6,422,199 B1 7/2002 Buckley et al.
6,422,210 B1 7/2002 Lambert et al.
6,425,368 B1 7/2002 Lambert
6,431,469 B2 8/2002 Lambert et al.
6,434,822 B1 8/2002 Perry et al.
6,454,191 B1 9/2002 Spakowski et al.
6,454,192 B2 9/2002 Perry
6,464,153 B1 10/2002 Bonnah, II et al.
6,467,702 B1 10/2002 Lambert et al.
6,471,142 B1 10/2002 Lambert
6,480,641 B1 11/2002 Ding et al.
6,502,555 B1 1/2003 Harcombe et al.
6,508,416 B1 1/2003 Mastro et al.
6,511,004 B2 1/2003 Landschoot et al.
6,513,733 B1 2/2003 Lambert
6,520,154 B2 2/2003 Lamb et al.
6,588,102 B1 7/2003 Perry et al.
6,601,784 B2 8/2003 Muller-Girard, Jr. et al.
6,612,508 B2 9/2003 Lambert
6,616,070 B1 9/2003 Kunkulagunta
6,629,650 B2 10/2003 Curran et al.

* cited by examiner

FUEL INJECTOR

FIELD OF THE INVENTION

This invention relates to a fuel injector having a control valve arrangement for use in controlling fluid pressure within a control chamber. In particular, the invention relates to a fuel injector for use in the delivery of fuel to a combustion space of an internal combustion engine.

BACKGROUND OF THE INVENTION

It is known to provide a fuel injector with a control valve arrangement which is arranged to control movement of a fuel injector valve needle relative to a seating so as to control the delivery of fuel from the injector. Movement of the valve needle away from the seating permits fuel to flow from a delivery chamber through an outlet of the injector into the engine cylinder or other combustion space.

The control valve arrangement includes a control valve member which is movable between a first position, in which fuel under high pressure is able to flow into the control chamber, and a second position in which the control chamber communicates with a low pressure fuel reservoir. A surface associated with the valve needle is exposed to fuel pressure within the control chamber such that the pressure of fuel within the control chamber applies a force to the valve needle to urge the valve needle against its seating.

In order to commence injection, the valve arrangement is actuated such that the control valve member is moved into its second position, thereby causing fuel pressure within the control chamber to be reduced. The force urging the valve needle against its seating is therefore reduced and fuel pressure within the delivery chamber serves to lift the valve needle away from its seating to permit fuel to flow through the injector outlet. In order to terminate injection, the valve arrangement is actuated such that the control valve member is moved into its first position, thereby permitting fuel under high pressure to flow into the control chamber. The force acting on the valve needle due to fuel pressure within the control chamber is therefore increased, causing the valve needle to be urged against its seating to terminate injection.

Problems can occur in such arrangements as, when the control valve member is moving between its first and second positions, significant unbalanced hydraulic forces act on the control valve member. In particular, when it is desired to terminate injection, unbalanced forces acting on the control valve member serve to resist movement of the control valve member from its second position to its first position. The unbalanced forces acting on the control valve member therefore cause the control valve member to 'hover' between its first and second positions such that the re-establishment of high pressure fuel within the control chamber is either delayed or prevented. As a result, the valve needle of the injector may 'dither' between injecting and non-injecting positions, and this has a detrimental effect on injector performance.

It is an object of the present invention to provide a control valve arrangement which removes or alleviates the aforementioned disadvantage.

SUMMARY OF THE INVENTION AND ADVANTAGES

According to the present invention there is provided a fuel injector comprising a valve needle operable to control fuel delivery from the injector, and a control valve arrangement for use in controlling fuel pressure within a control chamber so as to control movement of the valve needle, wherein said control valve arrangement comprises a control valve member which is movable between a first position in which the control chamber communicates with a source of high pressure fuel and a second position in which the control chamber communicates with a low pressure fuel drain and communication between the control chamber and the source of high pressure fuel is broken, and restricted flow means for restricting the rate of flow of fuel from the source of high pressure fuel to the control chamber when the control valve member is moved towards its first position.

It has been found that the problem of unbalanced hydraulic forces acting on the control valve member to resist movement into the first position is substantially removed if the rate of flow of fuel between the source of high pressure fuel and the control chamber is restricted. The problem of control valve member 'hover' can therefore be alleviated.

Typically, the injector may be of the type in which the pressure of fuel within the control chamber applies a force to a surface associated with a valve needle of the injector to urge the valve needle towards a valve needle seating, in which position fuel injection does not occur. Upon a reduction in fuel pressure within the control chamber, the force acting on the valve needle is reduced, thereby causing the valve needle to lift away from the valve needle seating to commence injection.

The injector may be arranged such that, when the control valve member is in its first position, the valve needle is urged seated against the valve needle seating and fuel injection does not occur.

Preferably, the control valve member is slideable within a bore provided in a valve housing and the control valve member defines, together with a region of the bore, a restricted flow path through which fuel flows between the source of high pressure fuel and the control chamber.

The surface of the control valve member may be shaped to define, together with the region of the bore, the restricted flow path.

Alternatively, or in addition, the bore may be shaped to define, together with the surface of the control valve member, the restricted flow path.

The control valve member or the bore is preferably provided with an annular recess or groove arranged upstream of the restricted flow means. The provision of the annular groove or recess serves to reduce the disadvantageous temperature-dependent viscosity effects of high pressure fuel flowing through the restricted flow path.

Preferably, the control valve arrangement is arranged such that, when the control valve member is in its first position, the control valve member is in engagement with a first seating which is defined by a surface of a further housing adjacent the valve housing.

The control valve arrangement is preferably arranged such that, when the control valve member is in its second position, the control valve member is in engagement with a second seating which is defined by a surface of the bore.

When the control valve member is in the first position, a first flow area, A, is defined between the second seating and a surface of the control valve member. Preferably, the restricted flow path has a further flow area between one quarter of the first flow area (0.25 A) and the first flow area (A), and more preferably between 0.25 A and 0.75 A.

According to a second aspect of the present invention, there is provided a fuel injection system comprising a fuel injector as herein described.

BRIEF DESCRIPTION OF THE DRAWINGS

The invention will be described, by way of example, with reference to the accompanying drawings, in which.

DETAILED DESCRIPTION OF THE PREFERRED EMBODIMENT

Figure 1:
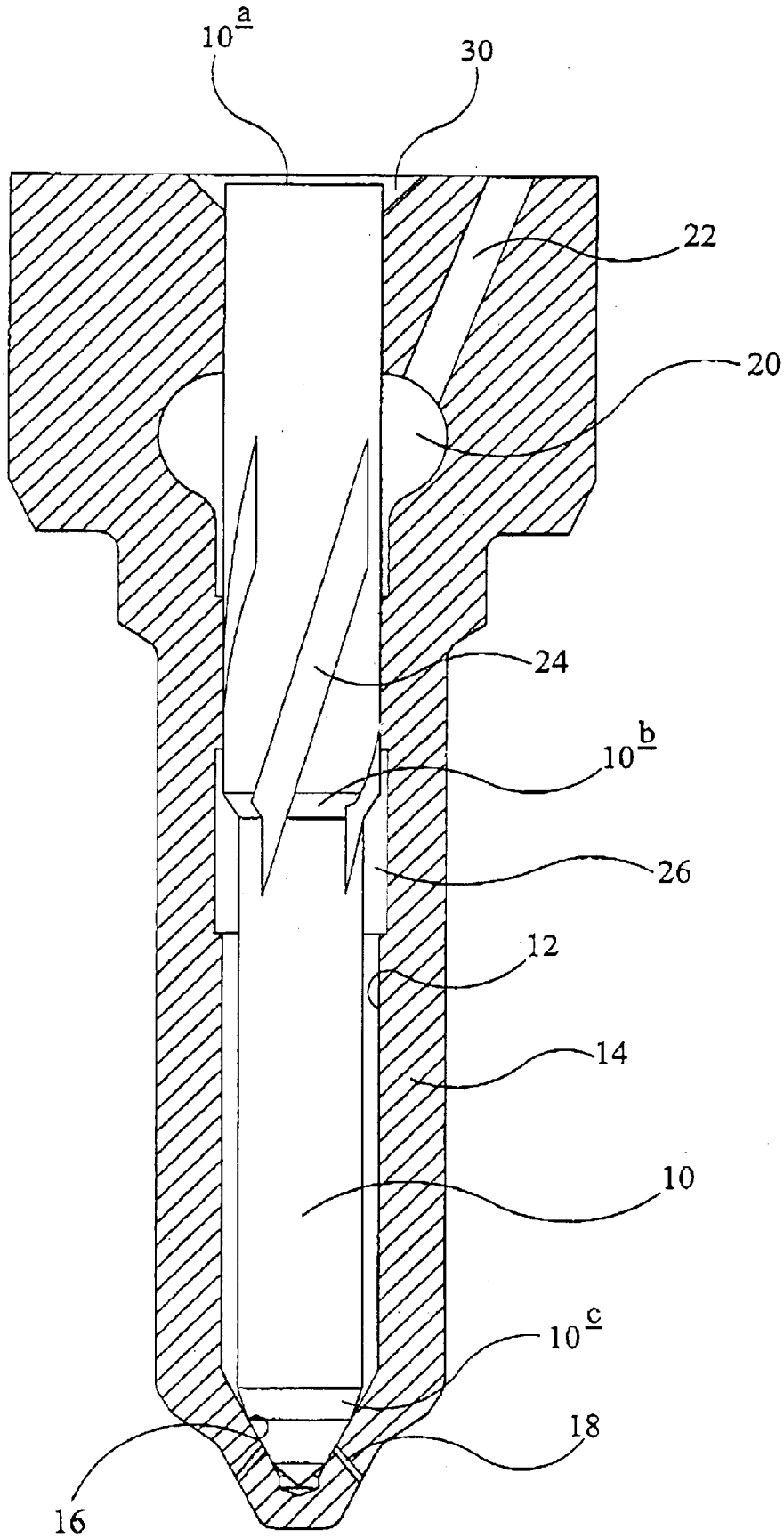
FIG 1 Prior Art
FIG. 1 is a sectional view of an injection nozzle of a known fuel injector.

Referring to FIG. 1, a fuel injector for use in delivering fuel to an engine cylinder or other combustion space of an internal combustion engine comprises a valve needle 10 which is slideable within a bore 12 provided in a nozzle body 14. The valve needle 10 is engageable with a valve needle seating 16 defined by the bore 12 so as to control fuel delivery through a set of outlet openings 18 provided in the nozzle body 14. The bore 12 is shaped to define an annular chamber 20 to which fuel under high pressure is delivered, in use, through a supply passage 22 provided in the nozzle body 14. Fuel delivered to the annular chamber 20 is able to flow through flats, grooves or flutes 24 provided on the surface of the valve needle 10 into a delivery chamber 26 defined between the valve needle 10 and the bore 12.

At the end of the valve needle 10 remote from the outlet openings 18, the end surface 10a of the valve needle 10 is exposed to fuel pressure within a control chamber 30. Fuel pressure within the control chamber 30 applies a force to the valve needle 10 which serves to urge the valve needle 10 against the valve needle seating 16 to prevent fuel injection through the outlet openings 18. In use, with high pressure fuel supplied to the annular chamber 20 through the supply passage 22 and, hence, to the delivery chamber 26, a force is applied to thrust surfaces 10*b*, 10*c* of the valve needle 10 which serves to urge the valve needle 10 away from the valve needle seating 16. If fuel pressure within the control chamber 30 is reduced sufficiently, the force acting on the thrust surfaces 10*b*, 10*c* due to fuel pressure within the delivery chamber 26 is sufficient to overcome the force acting on the end surface 10*a* of the valve needle 10, such that the valve needle 10 lifts away from the valve needle seating 16 to commence fuel injection. Thus, by controlling fuel pressure within the control chamber 30, initiation and termination of fuel injection can be controlled.

It will be understood that the surface 10*a* of the valve needle may carry an additional component which is exposed to fuel pressure with in the control chamber 30.

Figure 2:
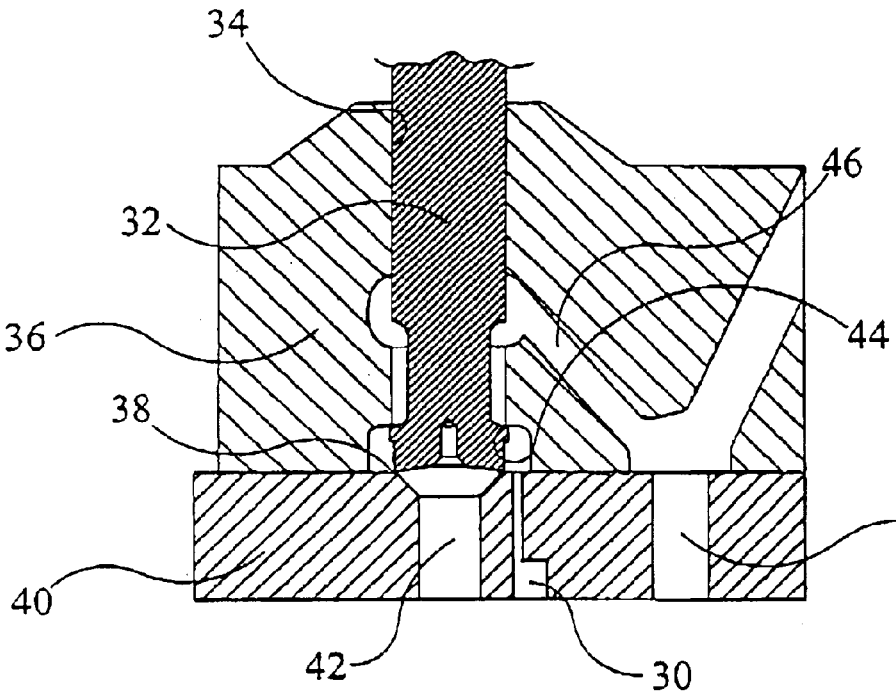
FIG 2 Prior Art
FIG. 2 is a sectional view of a conventional control valve arrangement for use with the injection nozzle in FIG. 1.

In a known fuel injector, the pressure of fuel within the control chamber 30 may be controlled by means of the control valve arrangement, as shown in FIG. 2. The control valve arrangement includes a control valve member 32 which is slideable within a further bore 34 defined in a valve housing 36. The valve housing 36 is in abutment with a further housing 40 within which the control chamber 30 is defined, at least in part. The further housing 40 is provided with a drilling which defines a flow passage 42 in communication with a low pressure fuel reservoir or drain.

The end face of the further housing 40 defines a first seating 38 with which an end of the control valve member 32 is engageable when the control valve member 32 is moved into a first position. The further bore 34 is shaped to define a second seating 44 with which a surface of the control valve member 32 is engageable when the control valve member 32 is moved into a second position. Conveniently, the control valve member 32 is biased into engagement with the first seating 38 by means of a spring (not shown) or other biasing means. Movement of the control valve member 32 may be controlled by means of an electromagnetic actuator arrangement or a piezoelectric actuator arrangement in a conventional manner.

In use, with the control valve member 32 in its first position such that the end of the control valve member 32 is in engagement with the first seating 38, fuel at high pressure is able to flow from the supply passage 22 through an intermediate flow passage 46 defined in the valve housing 36, past the second seating 44 and into the control chamber 30. In such circumstances, fuel pressure within the control chamber 30 is relatively high such that the valve needle 10 is urged against the valve needle seating 16. Thus, fuel injection through the outlet openings 18 does not occur. The control valve member 32 is shaped such that a flow path of relatively large diameter exists for fuel flowing through the intermediate flow passage 46, past the second seating 44 and into the control chamber 30 when the control valve member 32 is seated against the first seating 38.

When the control valve member 32 is moved away from the first seating 38 into engagement with the second seating 44, fuel within the supply passage 22 is no longer able to flow past the second seating 44 and fuel within the control chamber 30 is able to flow past the first seating 38 and through the flow passage 42 to the low pressure fuel reservoir. Fuel pressure within the control chamber 30 is therefore reduced and the valve needle 10 is urged away from the valve needle seating 16 as the force due to fuel pressure within the delivery chamber 26 acting on the thrust surface 10*b* of the valve needle is sufficient to overcome the reduced force acting on the end surface 10*a* of the valve needle 10.

In circumstances in which the control valve member 32 is moved away from the first seating 38 towards the second seating 44, hydraulic forces associated with fuel flow over the second seating 44 and restrictions in the flow passage 42 to drain act on the control valve member 32 so as to aid the actuation force causing movement of the control valve member 32. However, when the actuation force is removed and control valve member 32 is urged away from the second seating 44 towards the first seating 38 by means of the spring force, unbalanced hydraulic forces acting on the control valve member 32 due to the flow of fuel past the second seating 44 can cause the control valve member 32 to 'hover' between the second and first seatings 44, 38. It is therefore difficult to restore high pressure within the control chamber 30, such that the valve needle 10 may be caused to 'dither' between its injecting and non-injecting states.

Figure 3:
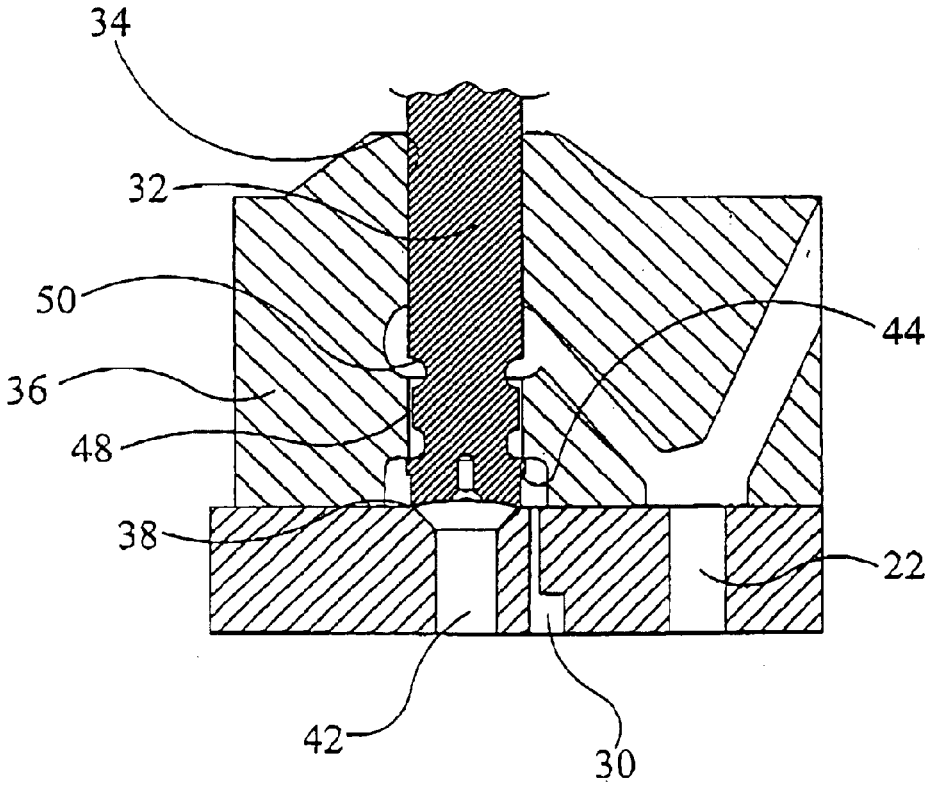
FIG. 3 is a sectional view of a control valve arrangement forming part of the present invention.

Referring to FIG. 3, the present invention alleviates this problem by providing restricted flow means for high pressure fuel flowing from the supply passage 22 into the control chamber 30 when the control valve member 32 is moved towards its first position against the first seating 38. The control valve member 32 is shaped to define, together with a region of the further bore 34, a restricted flow path 48 for fuel. The provision of the restricted flow path 48 serves to limit the rate at which fuel under high pressure can flow past the second seating 44 into the control chamber 30 when the control valve member 32 is moved against the first seating 38, such that the imbalance in hydraulic forces acting on the control valve member 32, which would otherwise resist movement of the control valve member 32 towards the first seating 38, is reduced.

Figure 4:
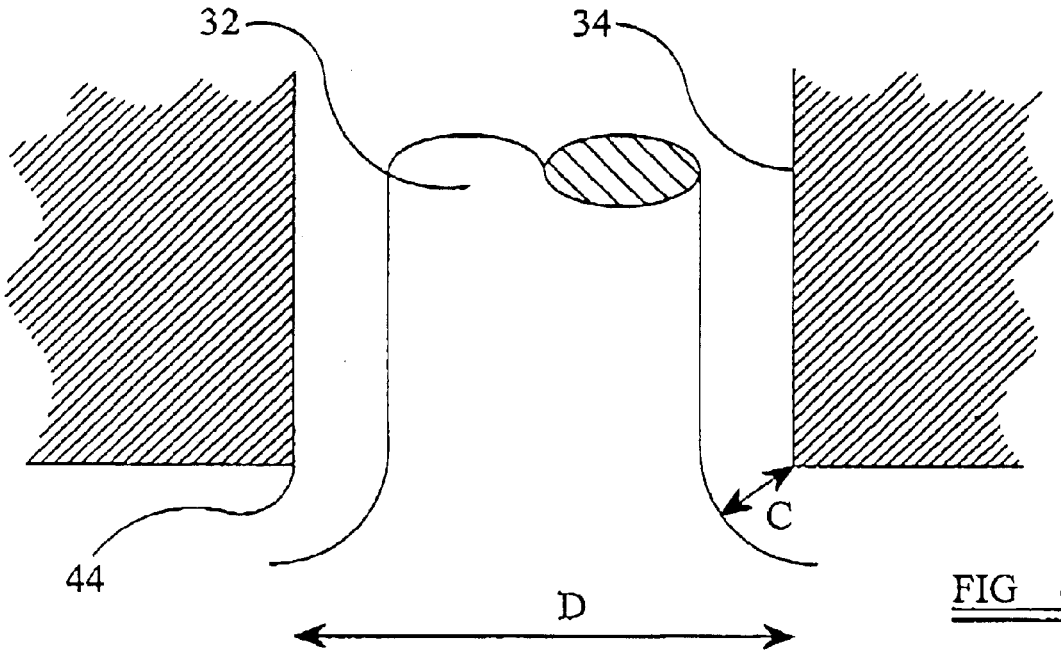
FIG. 4 is an enlarged, exaggerated view of a part of the control valve arrangement in FIG. 3.

As can be seen most clearly in FIG. 4, when the control valve member 32 is in a position in which it is seated against the first seating 38, a clearance is defined between the second seating 44 and the surface of the control valve member 32. Preferably, the control valve member 32 is shaped such that the restricted flow path 48 has a flow area between 0.25 A and A, and preferably between 0.25 A and 0.75 A. Typically, the diametrical clearance between the control valve member 32 and the further bore 34 in the region of the restricted flow path 48 is approximately 80% of the range of movement of the control valve member between its first position (when it is seated against the first seating 38) and its second position (when it is seated against the second seating 44) for a 90*o* seat. The clearance, C, identified in FIG. 4 is a linear dimension which, when revolved about the axis of the control valve member 32, defines a minimum flow area at the seat.

The control valve member 32 is also provided with an annular recess or groove 50 arranged upstream of the restricted flow path 48. The provision of the annular groove 50 limits the length of the restricted flow path 48. The annular groove 50 also ensures the detrimental temperature-dependent viscosity effects due to fuel flowing through the restricted flow path 48 are reduced.

Figure 5:
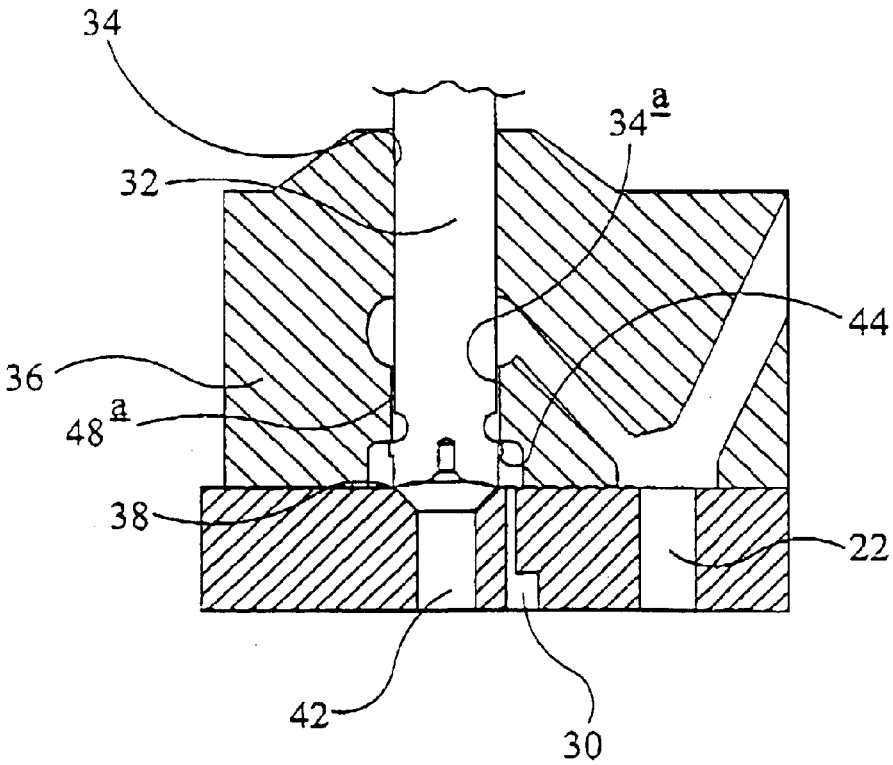
FIG. 5 is a sectional view of an alternative embodiment to that shown in FIG. 3.

FIG. 5 shows a further alternative embodiment of the invention in which the restricted flow means is provided by appropriate shaping of the further bore 34 provided in the valve housing 36, rather than by shaping the control valve member 32. In the embodiment shown in FIG. 5, the control valve member 32 has a substantially constant diameter along its length, the further bore 34 being shaped to define a region 34*a* of enlarged diameter which defines, together with the outer surface of the control valve member 32, a restricted flow path 48*a*. In practice, however, it may be more convenient to shape the control valve member 32, rather than the further bore 34 in the valve housing 36.

It will be appreciated that both the control valve member 32 and the further bore 34 may be shaped, if required, to define a restricted flow path of appropriate dimension. As an alternative to that shown in FIGS. 3 to 5, the control valve member 32 may have a substantially constant diameter along its length and may be provided with flats, slots or grooves to define the restricted flow path 48.

In a further alternative embodiment, the restricted flow path upstream of the second seating 44 may be defined by a restriction in the intermediate flow passage 46, and need not be defined by the control valve member 32 and/or the further bore 34.

Movement of the control valve member 32 may be controlled by means of an electromagnetic actuator arrangement, the control valve member 32 being coupled to an armature of the electromagnetic actuator arrangement such that energisation and de-energisation of an electromagnetic winding causes movement of the armature and, hence, movement of the control valve member 32. Alternatively, movement of the control valve member 32 may be controlled by means of a piezoelectric actuator arrangement comprising one or more piezoelectric elements.

It will be appreciated that the present invention is not limited to use with a fuel injector of the inwardly opening type, as shown in FIG. 1, but may be used in a fuel injector of the outwardly opening type in which movement of a valve needle outwardly from a bore enables fuel injection to be commenced. In an outwardly opening injector, an increase in fuel pressure within the control chamber 30 will give rise to initiation of injection, as the valve needle is urged outwardly from the bore, a reduction in fuel pressure within the control chamber 30 causing the valve needle to be urged inwardly within the bore, against its seating, to terminate injection.

It will further be appreciated that the control valve arrangement of the present invention is not limited to use in a fuel injector for controlling fuel delivery to an internal combustion engine, but may be used in any fluid control system.

What is claimed is:

1. A fuel injector comprising: a valve needle operable to control fuel delivery from the injector, and a control valve arrangement for use in controlling fuel pressure within a control chamber so as to control movement of the valve needle, wherein said control valve arrangement comprises a control valve member which is movable between a first position in which the control chamber communicates with a source of high pressure fuel and a second position in which the control chamber communicates with a low pressure fuel drain and communication between the control chamber and the source of high pressure fuel is broken, and a restricted flow path for restricting the rate of flow of fuel from the source of high pressure fuel to the control chamber when the control valve member is moved toward its first position, wherein the control valve member is slideable within a bore provided in valve housing and wherein the control valve member defines, together with a region of the bore the restricted flow path.

2. A fuel injector as claimed in claim 1, wherein the surface of the control valve member is shaped to define, together with the region of the bore, the restricted flow path.

3. A fuel injector as claimed in claim 2, wherein the bore is shaped to define, together with the control valve member, the restricted flow path.

4. A fuel injector as claimed in claim 1, wherein the valve member includes areas of greater and lesser diameter, the area of greater diameter on the control valve member defining, together with a region of the bore, the restricted flow path.

5. A fuel injector as claimed in claim 4 wherein the control valve member is engageable with a second seating defined by a surface of the bore, the control valve member engaging the second seating when in its second position.

6. A fuel injector as claimed in claim 4, wherein the control valve member is engageable with a first seating defined by a surface of a further housing adjacent the valve housing, the control valve member engaging the first seating when in its first position.

7. A fuel injector as claimed in claim 5 wherein a first flow area is defined by a clearance between the second seating and a second seating portion of the control valve member when the control valve member is in the first position, and wherein, a second flow area, being the restricted flow path, is defined by a clearance between the greater diameter area of the control valve member and the bore, wherein the area of the second flow area is measured in the range between one quarter of the first flow area and the first flow area.

8. A fuel injector as claimed in claim 6, wherein a first flow area is defined by a clearance between a second seating and a second seating portion of the control valve member when the control valve member is in the first position, and wherein a second flow area, being the restricted flow path, is defined by a clearance between the greater diameter area of the control valve member and the bore, wherein the area of the second flow area is measured in the range between one quarter of the first flow area and the first flow area.

9. A fuel injector as claimed in claim 1, wherein the control chamber is defined by a surface of the valve needle or a component carried thereby.

10. A fuel injector comprising: a valve needle operable to control fuel delivery from the injector, and control valve arrangement for use in controlling fuel pressure within a control chamber so as to control movement of the valve needle, wherein said control valve arrangement comprises a control valve member which is movable between a first position in which the control chamber communicates with a source of high pressure fuel and a second position in which the control chamber communicates with a low pressure fuel drain and communication between the control chamber and the source of high pressure fuel is broken, and a restricted flow path for restricting the rate of flow of fuel from the source of high pressure fuel to the control chamber when the control valve member is moved towards its first position, wherein the control valve member is provided with an annular recess or groove arranged upstream of the restricted flow path.

* * * * *